US005931135A

United States Patent [19]

Yamada

[11] Patent Number: 5,931,135

[45] Date of Patent: Aug. 3, 1999

[54] CYLINDER BLOCK OF INTERNAL COMBUSTION ENGINE

[75] Inventor: Satoshi Yamada, Toyota, Japan

[73] Assignee: Toyota Jidosha Kabushiki Kaisha, Toyota, Japan

[21] Appl. No.: 08/947,404

[22] Filed: Oct. 8, 1997

[30] Foreign Application Priority Data

Oct. 18, 1996 [JP] Japan ..... 8-276623

[51] Int. Cl.[6] ..... F02F 7/00

[52] U.S. Cl. ..... 123/195 C

[58] Field of Search ..... 123/195 C, 195 R, 123/193.2

[56] References Cited

U.S. PATENT DOCUMENTS 4,753,201 6/1988 Fukuo et al. ..... 123/195 C 5,222,467 6/1993 Sasada ..... 123/195 R 5,711,614 1/1998 Wuest et al. ..... 123/195 R

FOREIGN PATENT DOCUMENTS

A-5-157005 6/1993 Japan .

*Primary Examiner*—Marguerite McMahon

*Attorney, Agent, or Firm*—Oliff & Berridge, PLC

[57] ABSTRACT

In a cylinder block of an internal combustion engine, crank caps are bolted and a crankshaft is rotatably supported by the crank caps. The cylinder block includes bulkheads which divide an internal space of a crankcase into sub-sections for respective cylinders of the engine. Breathing holes are formed in each of the bulkheads and allow the sub-sections of the crankcase to communicate with each other via the breathing holes. Crank cap holes are formed in a bottom of each of the bulkheads. Bolts are fastened to the crank cap holes to fix the crank caps to the bulkheads. The crank cap holes are threaded holes which extend from the bottom of each of the bulkheads and are open to the breathing holes.

10 Claims, 3 Drawing Sheets

CYLINDER BLOCK OF INTERNAL COMBUSTION ENGINE

BACKGROUND OF THE INVENTION (1) Field of the Invention

The present invention generally relates to a cylinder block of an internal combustion engine, and more particularly to a cylinder block in which crank caps are bolted and a crankshaft is rotatably supported by the crank caps on crank journals.

(2) Description of the Related Art

As disclosed in Japanese Laid-Open Patent Application No.5-157005, there is known a cylinder block in which crank caps are bolted and a crankshaft is rotatably supported by the crank caps on crank journals. The cylinder block includes a plurality of cylinder bores corresponding to respective cylinders of an internal combustion engine. In the cylinder bores, pistons of the engine are capable of moving up and down during rotation of the engine, the pistons being connected to the crankshaft through connecting rods.

In the cylinder block, the crank caps are bolted to bottom portions of the cylinder block so that the crankshaft is rotatably supported by the crank caps on the crank journals of the cylinder block. The crank caps have bearing bores on which the crankshaft is supported in conjunction with the crank journals of the cylinder block.

The cylinder block includes a plurality of bulkheads which partition an internal space of a crankcase beneath the cylinder bores into sub-sections for the respective cylinders of the engine. The bulkheads includes the crank journals. In order to bolt the crank caps to the cylinder block, threaded holes are formed in a bottom of each of the bulkheads. Bolts are fastened to the threaded holes to secure the crank caps to the cylinder block.

In the cylinder block of the above-mentioned publication, the threaded holes are simply formed as closed-end threaded holes in the bulkheads. That is, the threaded holes have the ends enclosed with the internal walls of the bulkheads and not open to the internal space of the cylinder block.

Recently, in order to provide an engine having a lighter weight, cylinder blocks have come to be made of an aluminum alloy, which are different from a conventional cylinder block made of cast iron. In addition, in order to provide a good ventilation for the crankcase of the cylinder block and reduce a friction loss of the engine, breathing holes are formed in the bulkheads of the cylinder block. Further, in order to provide a compact engine having a lighter weight, a distance between two of the cylinder bores of the cylinder block in an axial direction of the crankshaft provided in the crankcase is set to be relatively small. Each of the bulkheads in the cylinder block is provided with raised portions and thin-wall portions. In each bulkhead, the raised portions are formed as having a thickness greater than a thickness of the thin-wall portions.

Generally, the bulkheads of the cylinder block on which the crankshaft is supported are subjected to explosive forces and thermal stresses produced during the rotation of the engine. Further, the bulkheads of the cylinder block are subjected to steep changes in pressure produced by the upward and downward movements of the pistons in the cylinder bores during the rotation of the engine. The corner locations between the raised portions and the thin-wall portions in each of the bulkheads are likely to suffer the concentration of the forces and stresses produced during the rotation of the engine.

As described above, the breathing holes are provided in each of the bulkheads. The breathing holes function to avoid the concentration of the forces and thermal stresses at the corners of the bulkheads produced during the rotation of the engine, and function to reduce the pressure changes of the corners of the bulkheads produced during the rotation of the engine. Consequently, the breathing holes are effective in preventing the occurrence of cracks or damages of the corner locations of the bulkheads during the rotation of the engine.

In the cylinder block of the above-mentioned publication, it is required that the threaded holes to which the bolts are fastened to fix the crank caps to the cylinder block be formed in the bulkheads. The threaded holes are formed in each bulkhead in two stages: a drilling of holes before threading; and a thread cutting of the holes in the bulkhead by using a tap.

Since the explosive forces and thermal stresses produced during the rotation of the engine are directly applied to the crankshaft provided in the crankcase of the cylinder block, it is necessary to firmly support the crankshaft on the crank journals of the cylinder block. Because of this, a length of the connection between the bolts and the threaded holes in the bulkheads has to be relatively long in order to firmly support the crankshaft on the crank journals. Therefore, it is required that the threaded holes which are relatively deep be formed in the bulkheads.

However, in the cylinder block of the above-mentioned publication, the threaded holes are simply formed as the closed-end holes in the bulkheads. It is difficult to clear away chips produced during the cutting of the threaded holes in the bulkheads. It is difficult to supply a cutting fluid to the threaded holes during the cutting thereof. Therefore, in a case of the cylinder block of the above-mentioned publication, it is very difficult to ensure accurate machining of the threaded holes in the bulkheads.

In a case in which the cylinder block is made from an aluminum alloy in order to provide an engine having a lighter weight, it is more difficult to clear away the chips produced during the cutting of the threaded holes in the bulkheads due to a high toughness of the aluminum alloy.

In order to ensure an accurate machining of the threaded holes in the bulkheads even if the aluminum alloy is used, it is necessary to decrease the cutting speed. If the cutting speed is decreased, the efficiency of the machining for the cylinder block has to be lowered. In particular, when the threaded holes which are relatively deep are formed in the bulkheads, the efficiency of the machining for the cylinder block of the above-mentioned publication will be considerably lowered if the cutting speed is decreased.

SUMMARY OF THE INVENTION

An object of the present invention is to provide an improved cylinder block in which the above-described problems are eliminated.

Another object of the present invention is to provide a cylinder block which provides an increased efficiency and accuracy of the machining of crank cap holes in bulkheads between sub-sections of a crankcase.

The above-mentioned objects of the present invention are achieved by a cylinder block in which crank caps are bolted and a crankshaft is rotatably supported by the crank caps, which comprises: bulkheads which divide an internal space of a crankcase into sub-sections for respective cylinders of an internal combustion engine; breathing holes, formed in each of the bulkheads, which allow the sub-sections of the crankcase to communicate with each other via the breathing holes; and crank cap holes, formed in a bottom of each of the bulkheads, to which bolts are fastened to fix the crank caps to the bulkheads, the crank cap holes being threaded holes which extend from the bottom of each of the bulkheads and are open to the breathing holes.

In the cylinder block of the present invention, the crank cap holes to which the crank cap bolts are fastened are formed as the open-end threaded holes extending from the bottoms of the bulkheads to the breathing holes. Chips produced during the machining of the crank cap holes can easily come out of the cylinder block from not only the bottoms of the bulkheads but also the breathing holes. Therefore, the chips detrimental to the accuracy of the machining of the crank cap holes can be easily cleared away, and the cylinder block of the present invention is effective in providing an increased accuracy of the machining of the crank cap holes in the bulkheads.

Further, in the cylinder block of the present invention, a cutting fluid used for the machining can be invariably supplied from the breathing holes to the crank cap holes. Therefore, it is possible to avoid burning of the cylinder block even when the crank cap holes which are relatively deep in the bulkheads are formed. It is possible to provide an adequate level of cooling and lubrication for the locations of the crank cap holes in the cylinder block during the machining thereof. Since the cylinder block of the present embodiment can prevent the chips from remaining in the crank cap holes during the machining of the crank cap holes in the bulkheads, it is no longer necessary to decrease the cutting speed in order to ensure an accurate machining for an aluminum alloy having a high toughness. Even if the cylinder block is made from the aluminum alloy, it is possible for the cylinder block of the present invention to carry out the machining of the crank cap holes in the bulkheads without decreasing the cutting speed. Accordingly, the cylinder block of the present invention is effective in providing an increased efficiency and accuracy of the machining of the crank cap holes in the bulkheads.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENT

A description will now be given of the preferred embodiment of the present invention with reference to the accompanying drawings.

Figure 1:
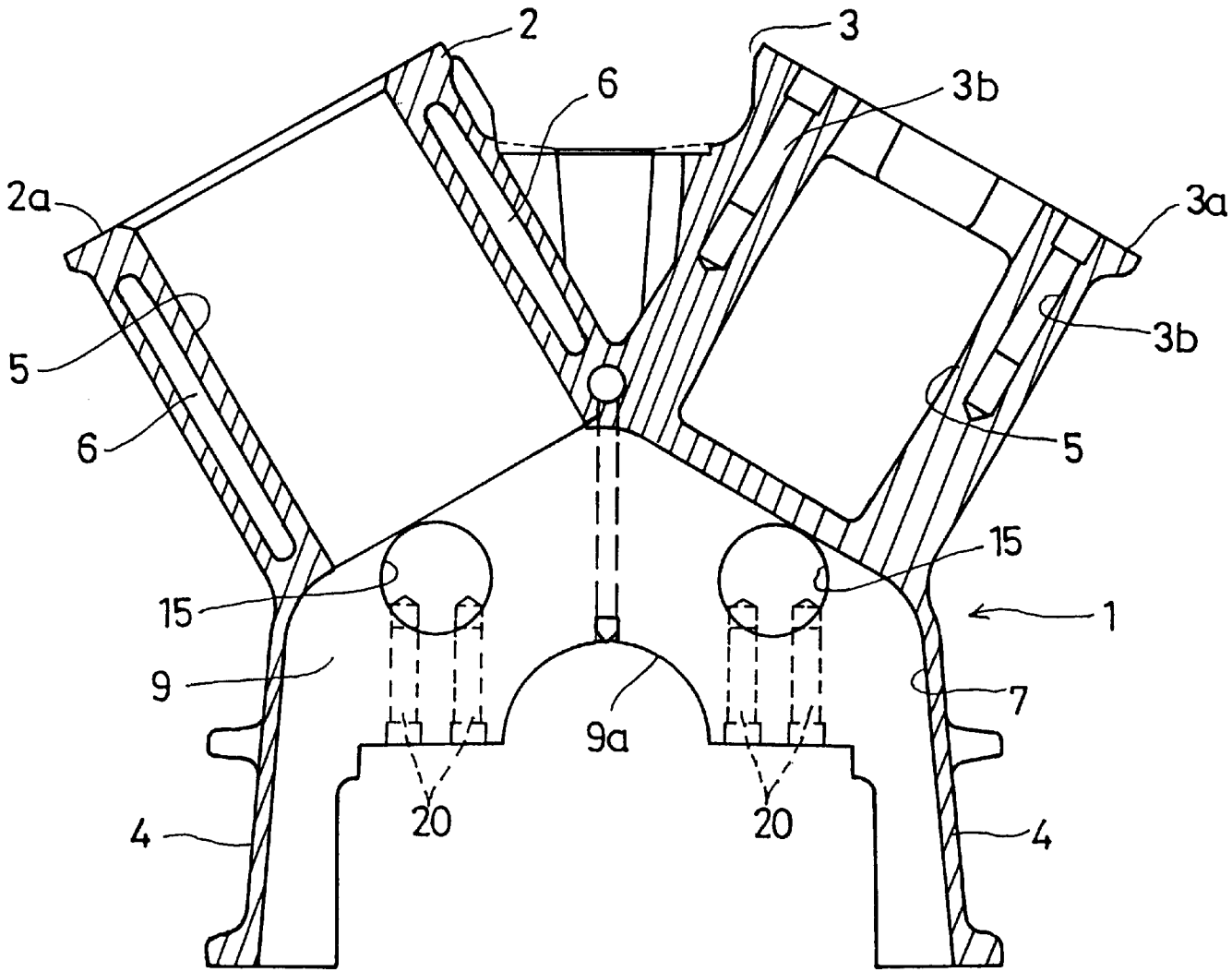
FIG. 1 is a cross-sectional view of one embodiment of a cylinder block of the present invention.
Figure 2:
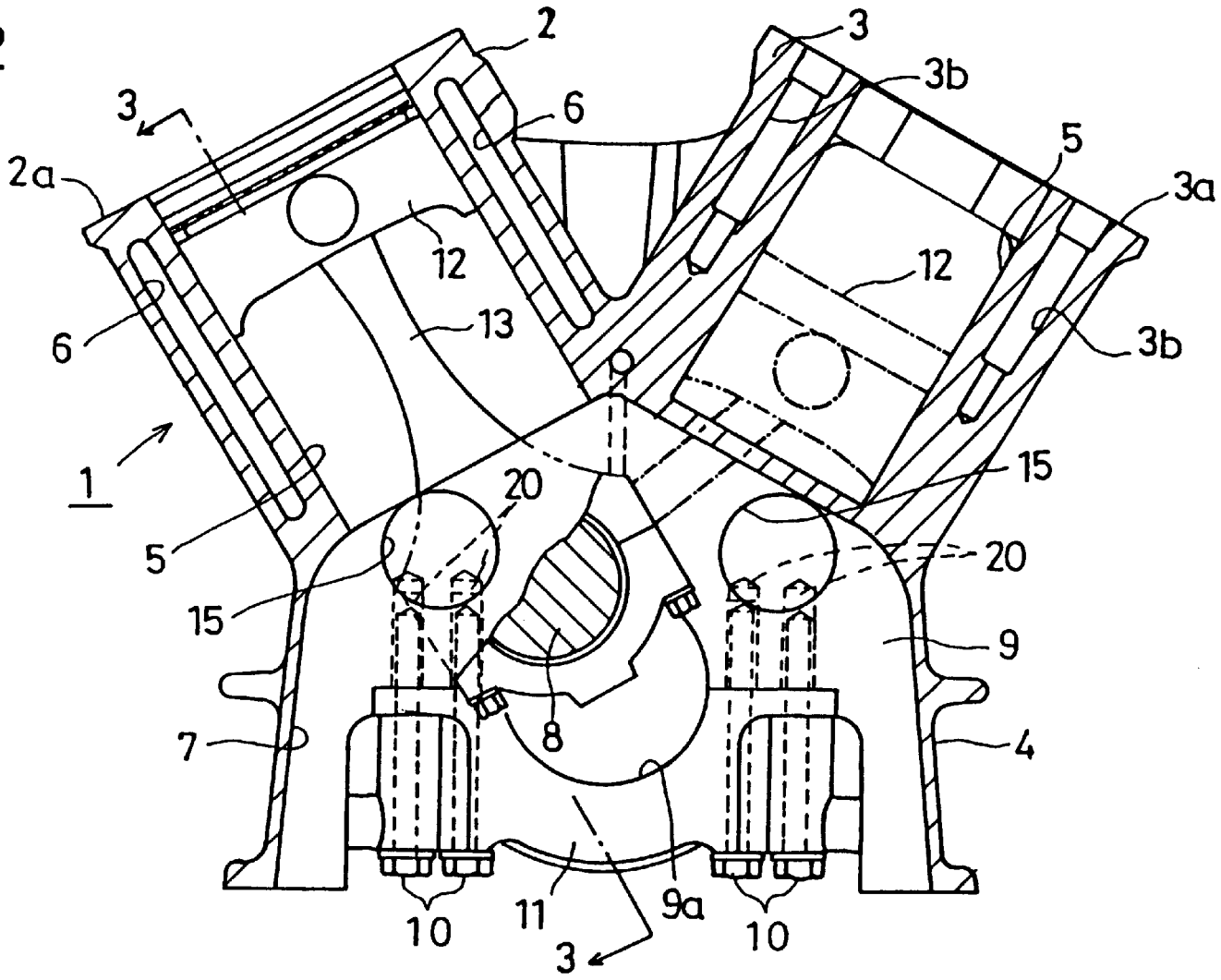
FIG. 2 is a cross-sectional view of an internal combustion engine to which the embodiment of the cylinder block of the present invention is applied.

FIG. 1 shows one embodiment of a cylinder block of the present invention. FIG. 2 shows an internal combustion engine to which the embodiment of the cylinder block of the present invention is applied.

For the sake of convenience, in the following description, it is supposed that the engine is a V-engine and the embodiment of the cylinder block is applied to the V-engine.

As shown in FIG. 1 and FIG. 2, a cylinder block 1 and other components are connected together to constitutes the V-engine. The cylinder block 1 is made of an aluminum alloy to provide an engine having a lighter weight. The cylinder block 1 generally has a left bank 2 and a right bank 3 which extend slantingly upward, and a skirt 4 which extends downward from the bank 2 and the bank 3. In each of the banks 2 and 3, a plurality of cylinder bores 5 (for example, three cylinder bores for a six-cylinder engine) are provided.

A water jacket 6 is formed in the wall of each of the banks 2 and 3 such that the water jacket 6 encircles the cylinder bores 5 for each of the banks 2 and 3. Further, in each of the banks 2 and 3, cylinder head holes 3*b* are formed. The cylinder head holes 3*b* are threaded holes to which bolts are fastened to fix a cylinder head (not shown) to the cylinder block 1.

A crankcase 7 is formed within the skirt 4 of the cylinder block 1 beneath the cylinder bores 5. An internal space of the crankcase 7 is formed by an inside wall of the skirt 4. An oil pan (not shown) is attached to a bottom of the skirt 4 so that the crankcase 7 is enclosed with the inside wall of the skirt 4 and the oil pan.

Figure 3:
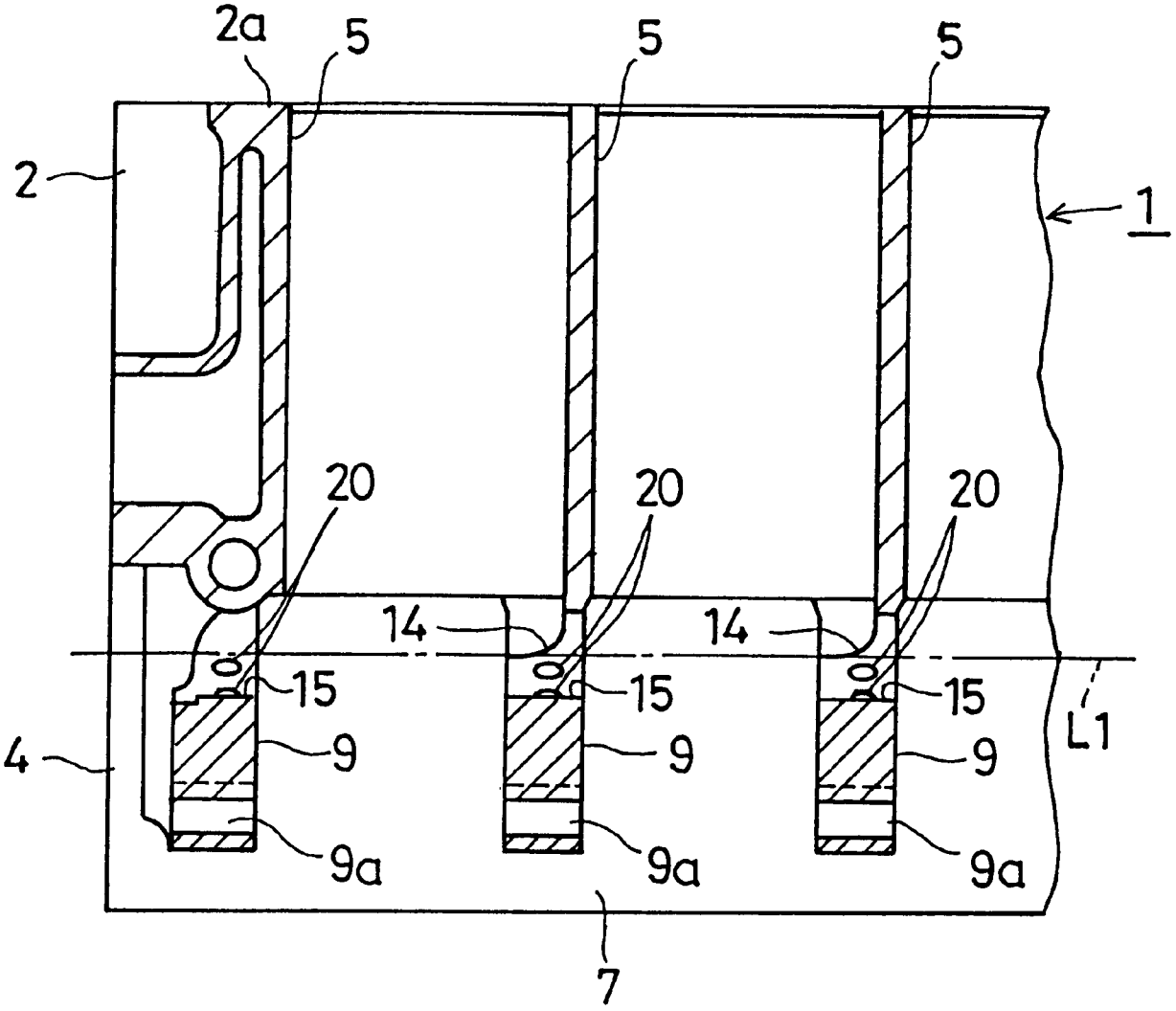
FIG. 3 is a cross-sectional view of the internal combustion engine taken along a line 3—3 indicated in FIG. 2.

FIG. 3 is a cross-sectional view of the internal combustion engine taken along a line A—A indicated in FIG. 2.

As shown in FIG. 3, in the cylinder block 1 of the present embodiment, a distance between two of the cylinder bores 5 in an axial direction of a crankshaft 8 is set to be relatively small in order to provide a compact engine having a lighter weight. In the crankcase 7 of the cylinder block 1, there are provided a plurality of bulkheads 9. The bulkheads 9 partition the internal space of the crankcase 7 into sub-sections for the respective cylinders of the engine. Each of the bulkheads 9 has a bearing bore 9*a* formed at a center location of the bottom of the bulkhead 9.

Referring back to FIG. 2, in the crankcase 7 of the cylinder block 1, the crankshaft 8 is supported on the bearing bores 9*a* of the bulkheads 9. A crank cap 11 is fixed to each of the bulkheads 9 by fastening crank cap bolts 10 to the bulkhead 9. The crankshaft 8 is rotatably supported on the bearing bores 9*a* of the bulkheads 9 and on the crank caps 11 bolted to the bulkheads 9.

As shown in FIG. 1, there are formed crank cap holes 20 in the bottom of each of the bulkheads 9. The crank cap holes 20 are formed in each of the bulkheads 9 as threaded holes, and the crank cap bolts 10 are fastened to the threaded holes so that the crank caps 11 are secured to the bulkheads 9 and the crankshaft 8 is supported on the bearing bores 9*a* of the bulkheads 9 by the crank caps 11. For the sake of convenience, a description of the crank cap holes 20 will be given later.

A plurality of pistons 12 are arranged in the cylinder bores 5 so that each of the pistons 12 is capable of moving up and down within one of the cylinder bores 5. The pistons 12 are connected to the crankshaft 8 via connecting rods 13. The connecting rods 13 are connected to the pistons 12, and the other ends of the connecting rods 13 are connected to the crankshaft 8. During normal operation of the engine, the pistons 12 move up and down within the cylinder bores 5. The movement of the pistons 12 is transmitted to the crankshaft 8 through the connecting rods 13 so that the crankshaft 8 is rotated by the movement of the pistons 12.

Referring to FIG. 3, in order to provide a compact engine having a lighter weight, each of the bulkheads 9 in the cylinder block 1 is provided with raised portions 14 and thin-wall portions. Each of the bulkheads 9 is formed at locations near the raised portions 14 as having a thickness greater than a thickness of the thin-wall portions. The crank cap holes 20 are formed in the locations of each of the bulkheads 9 having the greater thickness as shown in FIG. 3.

In each of the bulkheads 9, a breathing hole 15 having a circular cross section is formed. As shown in FIG. 2 and FIG. 3, the breathing holes 15 of the bulkheads 9 are arrayed in two rows extending in the axial direction of the crankshaft 8 in the crankcase 7 of the cylinder block 1. The breathing holes 15 of the bulkheads 9 are provided coaxially with a centerline "L1" (indicated by a one-dot chain line in FIG. 3), the centerline "L1" being parallel with the axial direction of the crankshaft 8 in the crankcase 7 of the cylinder block 1.

As described above, the bulkheads 9 of the cylinder block 1 are subjected to the explosive forces and thermal stresses produced during the rotation of the engine. Further, the bulkheads 9 of the cylinder block 1 are subjected to the steep changes in the pressure produced by the upward and downward movements of the pistons 12 in the cylinder bores 5 during the rotation of the engine.

The breathing holes 15 are provided at the locations, shown in FIG. 1 and FIG. 3, in each of the bulkheads 9, and the breathing holes 15 function to avoid the concentration of the forces and thermal stresses at the corners of the raised portions 14 produced during the rotation of the engine, and function to reduce the pressure changes of the corners of the raised portions 14 produced during the rotation of the engine. Consequently, the cylinder block 1 of the present embodiment is effective in preventing the occurrence of the cracks or damages of the raised portions 14 of the bulkheads 9 during the rotation of the engine.

In addition, the breathing holes 15 allow the sub-sections of the crankcase 7 between the bulkheads 9 to communicate with each other via the breathing holes 15, and the breathing holes 15 function to provide a good ventilation for the internal space of the crankcase 7 in the cylinder block 1. This enables the pistons 12 to smoothly move up and down in the cylinder bores 5 during the rotation of the engine. It is possible for the cylinder block 1 of the present embodiment to reduce the friction loss of the engine.

As shown in FIG. 1 and FIG. 2, in the present embodiment, the crank cap holes 20 are provided in each of the bulkheads 9 as threaded holes which extend from the bottom of each of the bulkheads 9 and are open to the breathing holes 15, and the crank cap bolts 10 are fastened to the threaded holes so that the crank caps 11 are secured to the bulkheads 9 and the crankshaft 8 is supported on the bearing bores 9*a* by the crank caps 11. It should be noted that the crank cap holes 20 in the present embodiment are formed as the open-end threaded holes extending from the bottom of each of the bulkheads 20 to the breathing holes 15.

It should be noted that, in the cylinder block 1 of the present embodiment, a length of the connection of one of the crank cap bolts 10 and one of the crank cap holes 20 in each of the bulkheads 9 is large enough for the crank caps 11 to withstand the explosive forces and thermal stresses applied to the crankshaft 8 in the crankcase 7 of the cylinder block 1 during rotation of the engine.

As described above, in the conventional cylinder block as disclosed in the Japanese Laid-Open Patent Application No.5-157005 mentioned above, the crank cap holes are formed as the closed-end threaded holes in the bulkheads.

The crank cap holes 20 in the present embodiment are formed as follows. Holes before threading are formed in each bulkhead 9 by drilling, the holes extending from the bottom of the bulkhead 9 and being open to the breathing holes 15. After the holes are formed, thread cutting is performed on the holes in the bulkhead 9 by using a tap, so that the crank cap holes 20 are formed.

As the crank cap holes 20 in the present embodiment are formed in each of the bulkheads 9 so as to be open to the breathing holes 15, chips produced during the drilling of the holes before threading can easily come out of the cylinder block 1 from not only the bottoms of the bulkheads 9 but also the breathing holes 15. In addition, chips produced during the thread cutting can easily come out of the cylinder block 1 primarily from the breathing holes 15.

According to the cylinder block 1 of the present embodiment, the chips produced during the machining of the crank cap holes 20 can easily come out of the cylinder block from not only the bottom of each of the bulkheads 9 but also the breathing holes 15. Therefore, the chips detrimental to the accuracy of the machining of the crank cap holes 20 can be easily cleared away, and it is possible to provide increased efficiency and accuracy of the machining of the crank cap holes 20 in the bulkheads 9.

Further, according to the cylinder block 1 of the present embodiment, cutting fluid used for the machining can be invariably supplied from the breathing holes 15 to the locations of the crank cap holes 20. Therefore, it is possible to avoid burning of the cylinder block 1 even when the crank cap holes which are relatively deep in the bulkheads 9 are formed. It is possible to provide an adequate level of cooling and lubrication for the locations of the crank cap holes in the cylinder block during the machining of the crank cap holes, and the cylinder block 1 of the present embodiment is effective in providing an increased efficiency and accuracy of the machining of the crank cap holes in the bulkheads.

Since the cylinder block of the present embodiment can prevent the chips from remaining in the crank cap holes during the machining of the crank cap holes in the bulkheads, it is no longer necessary to decrease the cutting speed in order to ensure an accurate machining for an aluminum alloy having a high toughness. Even if the cylinder block is made from the aluminum alloy in order to provide an engine having a lighter weight, it is possible to prevent the chips of the aluminum alloy from remaining in the crank cap holes during the drilling or thread cutting. Therefore, the cylinder block of the present embodiment can provide an increased efficiency and accuracy of the machining of the crank cap holes in the bulkheads.

Further, the present invention is not limited to the above-described embodiment, and variations and modifications may be made without departing from the scope of the present invention.

What is claimed is:

1. A cylinder block in which crank caps are bolted and a crankshaft is rotatably supported by the crank caps on crank journals, comprising:

bulkheads for dividing an internal space of a crankcase into sub-sections for respective cylinders of an internal combustion engine;

breathing holes formed in each of the bulkheads for allowing the sub-sections of the crankcase to communicate with each other via the breathing holes; and crank cap holes, formed in a bottom of each of the bulkheads, to which bolts are fastened to fix the crank caps to the bulkheads, the crank cap holes being threaded holes which extend from the bottom of each of the bulkheads and are open to the breathing holes.

2. The cylinder block according to claim 1, wherein the crank cap holes are provided in a plural number for one of the breathing holes of each of the bulkheads.

3. The cylinder block according to claim 1, wherein a length of connection of one of the bolts and one of the crank cap holes in each of the bulkheads is large enough for the crank caps to withstand forces and thermal stresses applied to the crankshaft in the crank case of the cylinder block during rotation of the engine.

4. The cylinder block according to claim 1, wherein the crank cap holes in each of the bulkheads vertically extend from the bottom of the bulkhead to the breathing holes and are open to the breathing holes such that chips produced during machining of the crank cap holes in the bulkhead can come out of the cylinder block from the bottom of the bulkhead and from the breathing holes.

5. The cylinder block according to claim 1, wherein the breathing holes of the bulkheads are arrayed in rows extending in an axial direction of the crankshaft in the crankcase of the cylinder block.

6. The cylinder block according to claim 1, wherein the breathing holes of the bulkheads are provided coaxially with a centerline which is parallel with an axial direction of the crankshaft in the crankcase of the cylinder block.

7. The cylinder block according to claim 1, wherein the bulkheads include the crank journals on which the crankshaft is rotatably supported by the crank caps.

8. The cylinder block according to claim 1, wherein each of the bulkheads is provided with raised portions and thin-wall portions, and the crank cap holes are provided adjacent to the raised portions of each of the bulkheads.

9. The cylinder block according to claim 1, further comprising a plurality of cylinder bores provided at upper portions of the cylinder block, a distance between two of the cylinder bores in an axial direction of the crankshaft being set to be relatively small.

10. The cylinder block according to claim 1, wherein said cylinder block is made of an aluminum alloy.

* * * * *